US011624497B1

(12) United States Patent
Hsu

(10) Patent No.: US 11,624,497 B1
(45) Date of Patent: Apr. 11, 2023

(54) CEILING LIGHT AND ADJUSTMENT METHOD THEREOF

(71) Applicant: DONGGUAN JIA SHENG LIGHTING TECHNOLOGY CO., LTD, Dongguan (CN)

(72) Inventor: Shuisheng Hsu, Dongguan (CN)

(73) Assignee: DONGGUAN JIA SHENG LIGHTING TECHNOLOGY CO., LTD, Dongguan (CN)

( * ) Notice: Subject to any disclaimer, the term of this patent is extended or adjusted under 35 U.S.C. 154(b) by 0 days.

(21) Appl. No.: 17/701,714

(22) Filed: Mar. 23, 2022

(30) Foreign Application Priority Data

Dec. 25, 2021 (CN) ..... 202123321748.6
Dec. 25, 2021 (CN) ..... 202123323789.9

(51) Int. Cl.
*F21V 19/02* (2006.01)
*F21S 8/04* (2006.01)

(52) U.S. Cl.
CPC ..... *F21V 19/02* (2013.01); *F21S 8/04* (2013.01)

(58) Field of Classification Search
CPC ..... F21V 19/02; F21S 8/04
See application file for complete search history.

(56) References Cited

U.S. PATENT DOCUMENTS 10,408,438 B2 9/2019 Hsu

FOREIGN PATENT DOCUMENTS

| | | | |
|---|---|---|---|
| CN | 205655195 | U | 10/2016 |
| CN | 207334491 | U | 5/2018 |
| CN | 207962357 | U | 10/2018 |
| CN | 109458598 | A | 3/2019 |
| CN | 210921102 | U | 7/2020 |
| CN | 212929586 | U | 4/2021 |

*Primary Examiner* — Karabi Guharay
(74) *Attorney, Agent, or Firm* — Andrew C. Cheng

(57) ABSTRACT

The present disclosure relates generally to the technical field of lighting devices, and more particularly to a ceiling light and an adjustment method thereof. The ceiling light includes a mounting plate, a light-emitting member and an adjusting assembly. The light-emitting member is disposed on the mounting plate. The light-emitting member and the mounting plate are fixed in a circumferential direction. The adjusting assembly runs through the mounting plate and the light-emitting member. The mounting plate and the adjusting assembly are adjustable in a circumferential direction. The adjusting assembly includes an action member on an outer side thereof corresponding to the light-emitting member. The light-emitting member includes a responsive member corresponding to lighting parameters. When the mounting plate and the adjusting assembly relatively move in the circumferential direction, the action member cooperates with the responsive member to realize the regulation of the light-emitting member.

19 Claims, 7 Drawing Sheets

CEILING LIGHT AND ADJUSTMENT METHOD THEREOF

TECHNICAL FIELD

The present disclosure relates generally to the technical field of lighting devices, and more particularly to a ceiling light and an adjustment method thereof.

BACKGROUND

Ceiling lights are lights that are attached to or embedded in the roof ceiling. Like chandeliers, they are also main indoor lighting equipment. Ceiling lights are often used in various places such as homes, offices and entertainment venues.

When adjusting lighting parameters such as light intensity or color temperature of conventional ceiling lights, users need to disassemble the lamp cover and other components until the internal adjustment knob is exposed, and then reinstall the components one by one after adjustment. The operation is complicated and the lights are easily damaged.

SUMMARY

In order to solve the problem that the operation is complicated and the lights are easily damaged as it is necessary to disassemble the light body when adjusting the lighting parameters, the present disclosure provides a ceiling light and an adjustment method thereof.

To solve the technical problem, an embodiment of the present disclosure provides a ceiling light. The ceiling light includes a mounting plate, a light-emitting member and an adjusting assembly. The light-emitting member is disposed on the mounting plate. The light-emitting member and the mounting plate are fixed in a circumferential direction. The adjusting assembly runs through the mounting plate and the light-emitting member. The mounting plate and the adjusting assembly are adjustable in a circumferential direction. The adjusting assembly includes an action member on an outer side thereof corresponding to the light-emitting member. The light-emitting member includes a responsive member corresponding to lighting parameters. When the mounting plate and the adjusting assembly relatively move in the circumferential direction, the action member cooperates with the responsive member to realize the regulation of the light-emitting member.

Preferably, the action member is a dial wheel which is disposed on the outer side of the adjusting assembly corresponding to the light-emitting member. The responsive member is an adjustment knob which is adapted to the dial wheel. When the mounting plate and the adjusting assembly relatively move in the circumferential direction, the dial wheel toggles the adjustment knob, to regulate the light-emitting member.

Preferably, the dial wheel includes a limiting member at a side thereof toward the light-emitting member. The mounting plate defines a first limiting slot corresponding to the limiting member. The light-emitting member defines a second limiting slot corresponding to the limiting member. During the mounting plate and the adjusting assembly relatively move in the circumferential direction, the limiting member is at least partially located in the second limiting slot.

Preferably, the circumferential widths of the first limiting slot and the second limiting slot along the adjusting assembly are larger than that of the limiting member along the adjusting assembly.

Preferably, the adjusting assembly includes a latching block at the outer side of an end thereof passing through the mounting plate. The latching block and the dial wheel clamp the mounting plate and the light-emitting member, so as to limit the mounting plate and the light-emitting member on the adjusting assembly in an axial direction.

Preferably, the mounting plate defines a first latching hole corresponding to the latching block. The light-emitting member defines a second latching hole corresponding to the latching block. The first latching hole and the second latching hole can be adjusted to be aligned, for the latching block passing through.

Preferably, the mounting plate includes an engaging element corresponding to an edge of the light-emitting member. The light-emitting member includes a positioning block corresponding to the engaging element. When the positioning block abuts against the engaging element, the first limiting slot being aligned with the second limiting slot.

Preferably, the mounting plate defines a first through hole. The light-emitting member defines a second through hole. When the positioning block abuts against the engaging element, the first through hole is aligned with the second through hole.

Preferably, the ceiling light further includes a lamp cover fastened on the mounting plate. The light-emitting member is sandwiched between the mounting plate and the lamp cover. The adjusting assembly runs through the mounting plate, the light-emitting member and the lamp cover.

Preferably, the adjusting assembly includes a locking assembly disposed at an end thereof passing through the lamp cover. The locking assembly includes a locking element, and a side of the locking element towards the lamp cover abuts against the lamp cover.

Preferably, the the locking element includes an anti-loosening structure.

Preferably, the locking assembly further includes a housing sleeved on the outer side of the adjusting assembly. The housing includes an outer edge extending to the lamp cover, to cover the locking element. The adjusting assembly includes an end cap disposed at an end thereof close to the lamp cover, so that the housing abuts against the lamp cover.

Preferably, the adjusting assembly includes a casing and a core shaft passing through the casing. The casing includes a tube chamber with a non-circular cross section, which is circumferentially limited with the core shaft. Or the casing includes a tube chamber with a circular cross section, which is rotatably connected to the core shaft. The action member is a dial wheel which is disposed on the outer side of the adjusting assembly corresponding to the light-emitting member. The responsive member is an adjustment knob which is adapted to the dial wheel.

Preferably, one end of the core shaft away from the light-emitting member passes through the casing and is connected to a surface of the ceiling light to be installed, the other end of the core shaft away from the mounting plate passes through the casing and limits the casing in an axial direction.

Preferably, the core shaft includes a fixing plate at the end thereof passing through the casing and close to the mounting plate. The fixing plate is connected to the surface of the ceiling light to be installed.

Preferably, the dial wheel defines a notch at a side towards the adjustment knob. The notch extends radially along the casing. The circumferential width of the notch on the centripetal side is larger than that of the notch on the centrifugal side.

Preferably, the adjustment knob can be a dial knob adapted to the dial wheel; or the light-emitting member includes an adjustment box, the adjustment knob partially penetrates out of the adjustment box to form the dial knob adapted to the dial wheel.

Preferably, the adjustment knob includes several settings with each setting matching with at least one lighting parameter or lighting mode; or the adjustment knob is electrodelessly adjusted and includes a series of continuous lighting parameters or lighting modes.

Preferably, the mounting plate includes a plate body and an arc edge disposed at an edge of the plate body. The plate body and the arc edge form a bowl-shaped structure which is fastened to the surface to be installed, thereby defining an operating space at a side of the plate body away from the light-emitting member.

To solve the above-mentioned technical problem, another embodiment of the present disclosure further provides an adjustment method of a ceiling light. The ceiling light includes a light-emitting member and an adjusting assembly. The adjusting assembly runs through the light-emitting member. The light-emitting member and the adjusting assembly are adjustable in a circumferential direction. The adjusting assembly includes an action member on an outer side thereof. The light-emitting member includes a responsive member correspondingly. The adjustment method includes the following steps: making the light-emitting member and the adjusting assembly relatively move in the circumferential direction, and the action member cooperates with the responsive member to regulate of the light-emitting member.

Compared with the prior arts, the ceiling light and the adjustment method thereof provided in the present disclosure have the following beneficial effects.

The ceiling light provided by the embodiment of the present disclosure includes includes a mounting plate, a light-emitting member and an adjusting assembly. The light-emitting member is disposed on the mounting plate. The light-emitting member and the mounting plate are fixed in a circumferential direction. The adjusting assembly runs through the mounting plate and the light-emitting member. The mounting plate and the adjusting assembly are adjustable in a circumferential direction. The adjusting assembly includes an action member disposed at an outer side thereof corresponding to the light-emitting member. The light-emitting member includes a responsive member. When the mounting plate and at least part of the adjusting assembly relatively move in the circumferential direction, the action member cooperates with the responsive member to realize the regulation of the light-emitting member. At least part of the outer side of the adjusting assembly adapted to the mounting plate and the light-emitting member has a circular cross section. The adjusting assembly 10 runs through the mounting plate and the light-emitting member, and the mounting plate and the adjusting assembly are adjustable in the circumferential direction, so that the mounting plate and at least part of the adjusting assembly can relatively move in the circumferential direction. In addition, the action member and the responsive member are respectively disposed at the outer side of the adjusting assembly and the light-emitting member, the light-emitting member and the mounting plate are fixed in the circumferential direction, so that when the mounting plate and at least part of the adjusting assembly relatively move in the circumferential direction, the action member cooperates with the responsive member to realize the regulation of lighting parameters of the light-emitting member. There is no need to disassemble the light body, the operation is simple and convenient, and it is also beneficial to prolong the service life of the light.

The action member is a dial wheel disposed at the outer side of the casing corresponding to the light-emitting member. The responsive member is an adjustment knob adapted to the dial wheel. When the mounting plate and the casing relatively move in the circumferential direction, the dial wheel toggles the adjustment knob, so as to regulate the light-emitting member. It can be understood that the dial wheel is disposed on the casing, for acting on the adjustment knob disposed on the light-emitting member when the mounting plate circumferentially moves relative to the adjusting assembly. The adjustment knob is adapted to the dial wheel to receive the response, thereby realizing the regulation of the lighting parameters such as the light intensity and color temperature of the light-emitting element. That is, when the lighting parameters need to be adjusted, rotating the mounting plate or rotating the casing, so that the dial wheel toggles the adjustment knob, thereby realizing the regulation of the lighting parameters of the light-emitting member.

The dial wheel includes a limiting member at a side thereof toward the light-emitting member. The mounting plate defines a first limiting slot corresponding to the limiting member. The light-emitting member defines a second limiting slot corresponding to the limiting member. The limiting member extends along the axial direction of the casing at least into the second limiting slot. The circumferential widths of the first limiting slot and the second limiting slot along the casing are larger than that of the limiting member along the casing. During the mounting plate and the casing relatively move in the circumferential direction, the limiting member is located in the second limiting slot, or partially located in the second limiting slot and partially located in the first limiting slot. It can be understood that the dial wheel includes the limiting member at the side thereof toward the light-emitting member, the limiting member extents into the second limiting slot of the light-emitting member, or partially into the second limiting slot of the light-emitting member and partially into the first limiting slot of the mounting plate. Since the widths of the first limiting slot and the second limiting slot are larger than that of the limiting member, the casing and the mounting plate can circumferentially moves within a certain range, thereby regulating the lighting parameters of the light-emitting member.

The casing includes at least one latching block extending radially along the casing, at an outer side of an end thereof passing through the mounting plate. The latching block and the dial wheel clamp the mounting plate and the light-emitting member, so as to limit the mounting plate on the casing in the axial direction. It can be understood that the latching block is located at a side of the mounting plate away from the light-emitting member, the dial wheel is located at a side of the light-emitting member away from the mounting plate. The distance between adjacent surfaces of the latching block and the dial wheel is equivalent to the distance between opposite surfaces of the mounting plate and the light-emitting member, therefore, the positions of the mounting plate and the light-emitting member on the casing are limited.

The mounting plate defines a first latching hole corresponding to the latching block, and the light-emitting member defines a second latching hole corresponding to the latching block. The first latching hole and the second latching hole can be adjusted to be aligned, so that the latching block can pass through. Since the latching block and the dial wheel clamp the mounting plate and the light-emitting member, and the latching block needs to pass through the mounting plate and the light-emitting member, the mounting plate and the light-emitting member respectively define the first latching hole and the second latching hole. When the ceiling light needs to be disassembled or assembled, the mounting plate and the light-emitting member relatively rotate to align the first latching hole and the second latching hole, for the latching block passing through. After the latching block passes through, the mounting plate and the light-emitting member relatively rotate until the first latching hole and the second latching hole are misaligned; that is, the first latching hole and the second latching hole correspond to different circumferential positions of the casing, so that the latching block cannot pass through the mounting plate and the light-emitting member, thereby limiting the casing and the mounting plate in the axial direction, and the ceiling light is in a working state.

The mounting plate is provided with an engaging element corresponding to the edge of the light-emitting member, and the light-emitting member is provided with a positioning block corresponding to the engaging element. When the positioning block abuts against the engaging element, the first limiting slot is aligned with the second limiting slot. The engaging element is used to realize the connection between the light-emitting member and the mounting plate, especially for the circumferential positioning of the light-emitting member and the mounting plate. When the positioning block on the light-emitting member abuts against the engaging element on the mounting plate, the first limiting slot is aligned with the second limiting slot, so that the limiting member extends into the second limiting slot, or partially into the second limiting slot and partially into the first limiting slot. Meanwhile, the first latching hole and the second latching hole are misaligned, to limit the adjusting assembly and the mounting plate in the axial direction.

The ceiling light further includes a lamp cover fastened to the mounting plate. The light-emitting member is sandwiched between the mounting plate and the lamp cover. The adjusting assembly runs through the mounting plate, the light-emitting member and the lamp cover. A locking assembly is disposed at an end of the casing and the core shaft passing through the lamp cover. The locking assembly includes a locking element engaged with the outer side of the casing. The side of the locking element toward the lamp cover abuts against the lamp cover. The lamp cover is fastened to the mounting plate, which can protect the light-emitting member, the action member and the responsive member, etc. The locking assembly is disposed at the end of the casing passing through the lamp cover, which can limit the position of the lamp cover on the casing. The locking element is engaged with the outer side of the casing and abuts against the lamp cover, which can fasten the lamp cover to the mounting plate.

The adjusting assembly includes a casing and a core shaft passing through the casing. The casing includes a tube chamber with a non-circular cross section, which is circumferentially limited with the core shaft; or the casing is rotatably connected to the core shaft. One end of the core shaft away from the light-emitting member passes through the casing and is connected to the surface of the ceiling light to be installed. The other end of the core shaft away from the mounting plate passes through the casing and limits the casing in the axial direction. So the lighting parameters of the light-emitting member can be regulated by rotating the mounting plate or directly rotating the casing.

The adjustment method of the ceiling light provided by the embodiment of the present disclosure has the following beneficial effects. Through the structure change between the light elements, the purpose of adjusting the light-emitting parameters of the light-emitting member can be achieved directly by means of the circumferential movement of the light-emitting member and the adjusting assembly, which is simple and feasible.

NUMERICAL REFERENCE IDENTIFICATION

Figure 1:
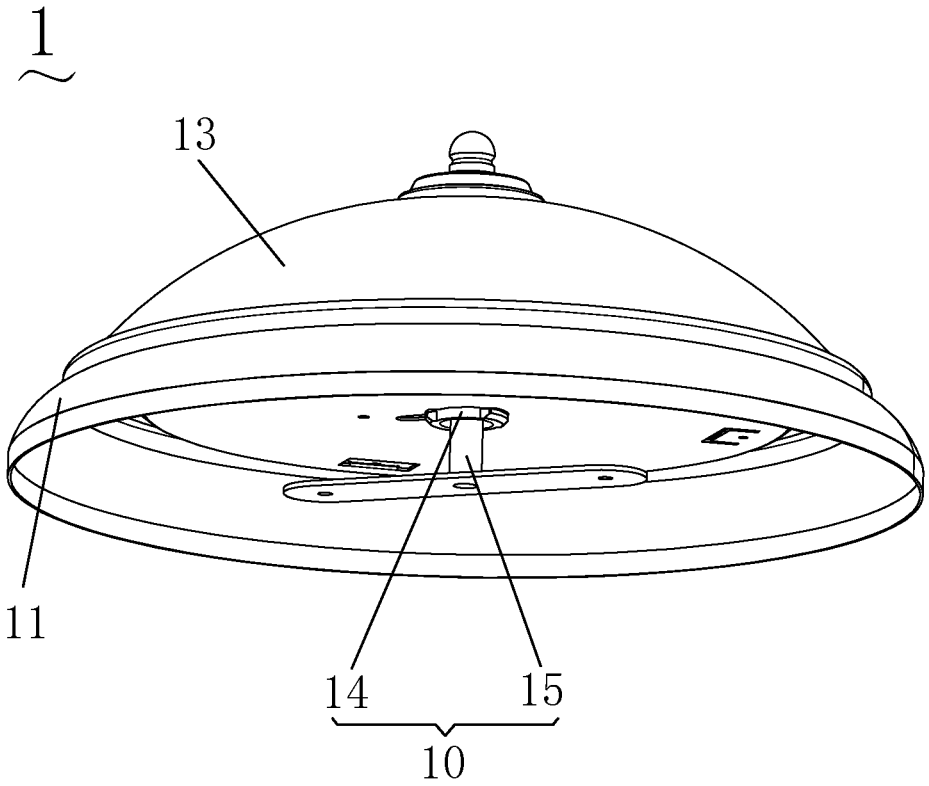
FIG. 1 is a perspective view of a ceiling light according to the present disclosure.

1. ceiling light;

10. adjusting assembly; 11. mounting plate; 12. light-emitting member; 13. lamp cover; 14. casing; 15. core shaft; 16. locking assembly;

111. plate body; 112. positioning assembly; 113. first latching hole; 114. first limiting slot; 115. first through hole; 116. arc edge; 120. responsive member; 121. substrate; 122. second latching hole; 123. second limiting slot; 124. adjustment knob; 125. second through hole; 126. lamp bead; 127. positioning block; 128. gap; 131. cover body; 132. hole; 140. action member; 141. latching block; 142. limiting member; 143. dial wheel;

1431. notch; 144. tube chamber; 151. core bar; 152. fixing plate; 161. locking element; 162. housing; 163. end cap;

1121. engaging element; 1122. positioning hole; 1611. protrusion; 1612. groove.

DETAILED DESCRIPTION

In order to make the objectives, technical solutions, and advantages of the present disclosure clearer, the present disclosure is further described in detail below with reference to the accompanying drawings and embodiments. It should be understood that the specific embodiments described herein are provided for illustration only, and not for the purpose of limiting the disclosure.

It should be noted that, when an element is considered to be "fixed" to another element, it can be directly fixed on another element or a centered element is arranged between the element and another element. When an element is considered to be "connected" to another element, it can be directly connected to another element or there can also have a centered element. It should be further noted that terms such as "vertical", "horizontal", "left", "right" or the like are just used to facilitate description of the present disclosure.

In the present disclosure, the orientation and position relationship indicated by the terms "up", "down", "left", "right", "front", "rear", "top", "bottom", "inner", "outer", "middle", "vertical", "horizontal", "transverse", "longitudinal", etc. are based on the orientation and position relationship shown in the drawings. These terms are primarily used to better describe the present disclosure and its embodiments, and are not intended to limit that the indicated device, element or component must have a particular orientation, or be configured and operated in a particular orientation.

In addition, some of the above-mentioned terms may be used to express other meanings besides orientation or position relationship. For example, the term "up" may also be used to express a certain attachment or connection relationship in some cases. For those skilled in the art, the specific meanings of these terms in the present disclosure can be understood according to specific situations.

Furthermore, the terms "mount", "dispose", "provide", "connect", "attach" should be construed broadly. For example, it may be a fixed connection, a detachable connection, or an integral structure; it may be a mechanical connection, or an electrical connection; it may be a direct connection, or an indirect connection through an intermediary, or an internal communication between two devices, elements or components. For those skilled in the art, the specific meanings of the above terms in the present disclosure can be understood according to specific situations.

Figure 2:
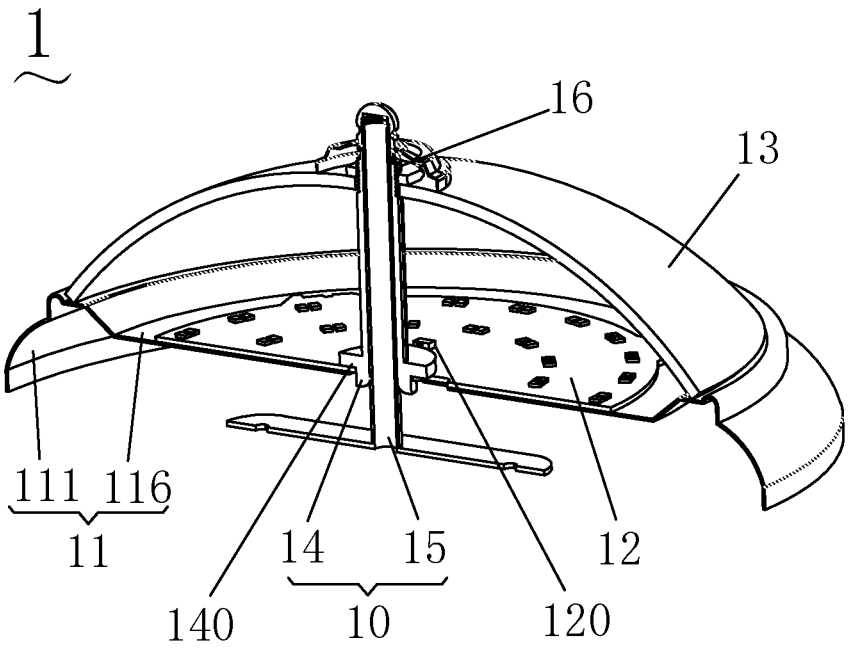
FIG. 2 is a longitudinal-sectional schematic diagram of the ceiling light according to the present disclosure.
Figure 3:
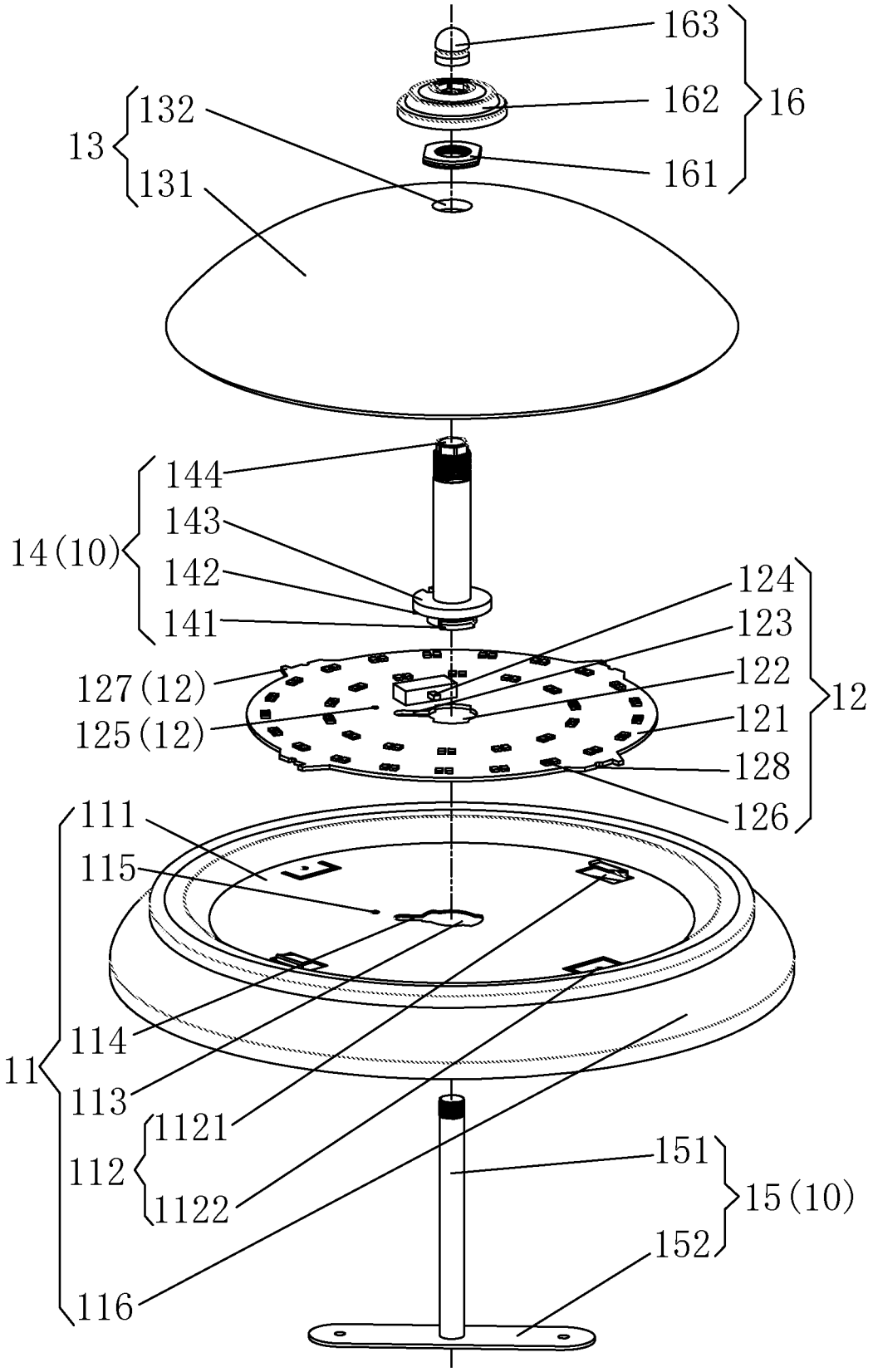
FIG. 3 is an exploded schematic diagram of the ceiling light according to the present disclosure.

Referring to FIGS. 1-3, an embodiment of the present disclosure provides a ceiling light 1. The ceiling light 1 includes a mounting plate 11, a light-emitting member 12 and an adjusting assembly 10. The light-emitting member 12 is disposed on the mounting plate 11. The light-emitting member 12 and the mounting plate 11 are fixed in a circumferential direction. The adjusting assembly 10 runs through the mounting plate 11 and the light-emitting member 12. The mounting plate 11 and the adjusting assembly 10 are adjustable in a circumferential direction. The adjusting assembly 10 includes an action member 140 disposed at an outer side thereof corresponding to the light-emitting member 12. The light-emitting member 12 includes a responsive member 120. When the mounting plate 11 and at least part of the adjusting assembly 10 relatively move in the circumferential direction, the action member 140 cooperates with the responsive member 120 to realize the regulation of the light-emitting member 12.

It can be understood that at least part of the outer side of the adjusting assembly 10 adapted to the mounting plate 11 and the light-emitting member 12 has a circular cross section. The adjusting assembly 10 runs through the mounting plate 11 and the light-emitting member 12, and the mounting plate 11 and the adjusting assembly 10 are adjustable in the circumferential direction, so that the mounting plate 11 and at least part of the adjusting assembly 10 can relatively move in the circumferential direction. In addition, the action member 140 and the responsive member 120 are respectively disposed at the outer side of the adjusting assembly 10 and the light-emitting member 12, the light-emitting member 12 and the mounting plate 11 are fixed in the circumferential direction, so that when the mounting plate 11 and at least part of the adjusting assembly 10 relatively move in the circumferential direction, the action member 140 cooperates with the responsive member 120 to realize the regulation of lighting parameters of the light-emitting member 12. There is no need to disassemble the light body, the operation is simple and convenient, and it is also beneficial to prolong the service life of the light.

Specifically, the light-emitting member 12 includes a substrate 121. The substrate 121 is provided with a lamp bead 126 centrally or eccentrically disposed thereon, or a plurality of lamp beads 126 disposed thereon in an orderly manner. The lamp beads 126 may be one or a combination of various small light-emitting units such as incandescent lamps, fluorescent lamps, gas discharge lamps, tungsten halogen lamps, LED lamps, etc.

Preferably, the mounting plate 11 includes a plate body 111 and an arc edge 116 disposed at the edge of the plate body 111. The plate body 111 and the arc edge 116 form a bowl-shaped structure fastened to a surface to be installed, thereby defining an operating space at a side of the plate body 111 away from the light-emitting member 12. The operating space can be used to accommodate the part of the adjusting assembly 10 passing through the plate body 111, and to accommodate power supply wires, etc. It can also facilitate the heat dissipation of the light-emitting member 12, and prolong the service life of the light-emitting member 12. In order to improve the usability and aesthetics, the arc edge 116 can also be provided with a hollow structure, texture decoration, coating decoration and the like.

As can be seen from the above, the light-emitting member 12 and the mounting plate 11 are circumferentially fixed. When the mounting plate 11 and at least part of the adjusting assembly 10 relatively move in the circumferential direction, the lighting parameters of the light-emitting member 12 can be regulated by the relative change. Therefore, there are two different regulation methods, that is, directly or indirectly rotating the mounting plate 11, or, directly or indirectly rotating at least part of the adjusting assembly 10, to regulate the lighting parameters of the light-emitting member 12.

Optionally, the adjusting assembly 10 includes a casing 14 and a core shaft 15 passing through the casing 14. The casing 14 includes a tube chamber 144 with a non-circular cross section, which is circumferentially limited with the core shaft 15. One end of the core shaft 15 away from the light-emitting member 12 passes through the casing 14 and is connected to the surface of the ceiling light 1 to be installed. The other end of the core shaft 15 away from the mounting plate 11 passes through the casing 14 and limits the casing 14 in an axial direction. The end of the core shaft 15, passing through the casing 14 and close to the port of the mounting plate 11, is connected to the surface of the ceiling light 1 to be installed. The casing 14 is circumferentially limited relative to the core shaft 15, so the lighting parameters of the light-emitting member 12 can be regulated by rotating the mounting plate 11.

Figure 9:
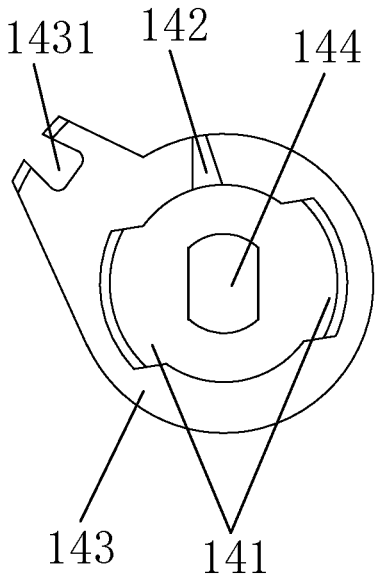
FIG. 9 is a schematic diagram of the dial wheel, the latching block, a positioning block and the shape of a tube chamber of the ceiling light according to the present disclosure.

Specifically, when the tube chamber 144 of the casing 14 has a non-circular cross section such as an ellipse, a polygon, etc. (as shown in FIG. 9), and a core bar 151 of the core shaft 15 inserted into the tube chamber 144 has an adapted cross section, the casing 14 and the core shaft 15 are circumferentially limited and cannot rotate relatively. Since the core shaft 15 is fixedly connected to the surface to be installed, the mounting plate 11 circumferentially moves relative to the casing 14 by rotating the mounting plate 11. The action member 140 acts on the responsive member 120, so that the lighting parameters of the light-emitting member 12 can be regulated.

Optionally, the adjusting assembly 10 includes the casing 14 and the core shaft 15 passing through the casing 14. The casing 14 includes the tube chamber 144 with a circular cross section, which is rotatably connected to the core shaft 15. One end of the core shaft 15 away from the light-emitting member 12 passes through the casing 14 and is connected to the surface of the ceiling light 1 to be installed. The other end of the core shaft 15 away from the mounting plate 11 passes through the casing 14 and limits the casing 14 in the axial direction. The end of the core shaft 15, passing through the casing 14 and close to the port of the mounting plate 11, is connected to the surface of the ceiling light 1 to be installed. The casing 14 is rotatably connected to the core shaft 15, so the lighting parameters of the light-emitting member 12 can be regulated by directly rotating the casing 14, or indirectly rotating the casing 14 through rotating other structures attached outside the casing 14.

Figure 10:
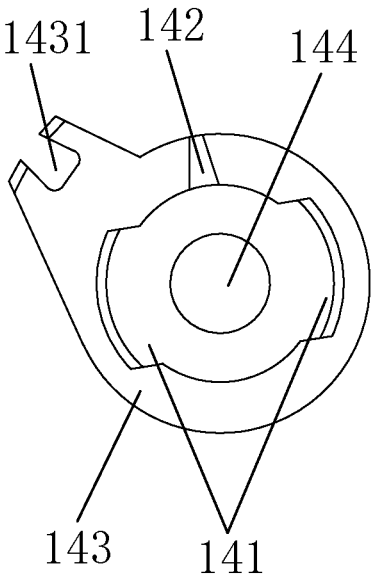
FIG. 10 is another schematic diagram of the dial wheel, the latching block, the positioning block and the shape of the tube chamber of the ceiling light according to the present disclosure.
Figure 11:
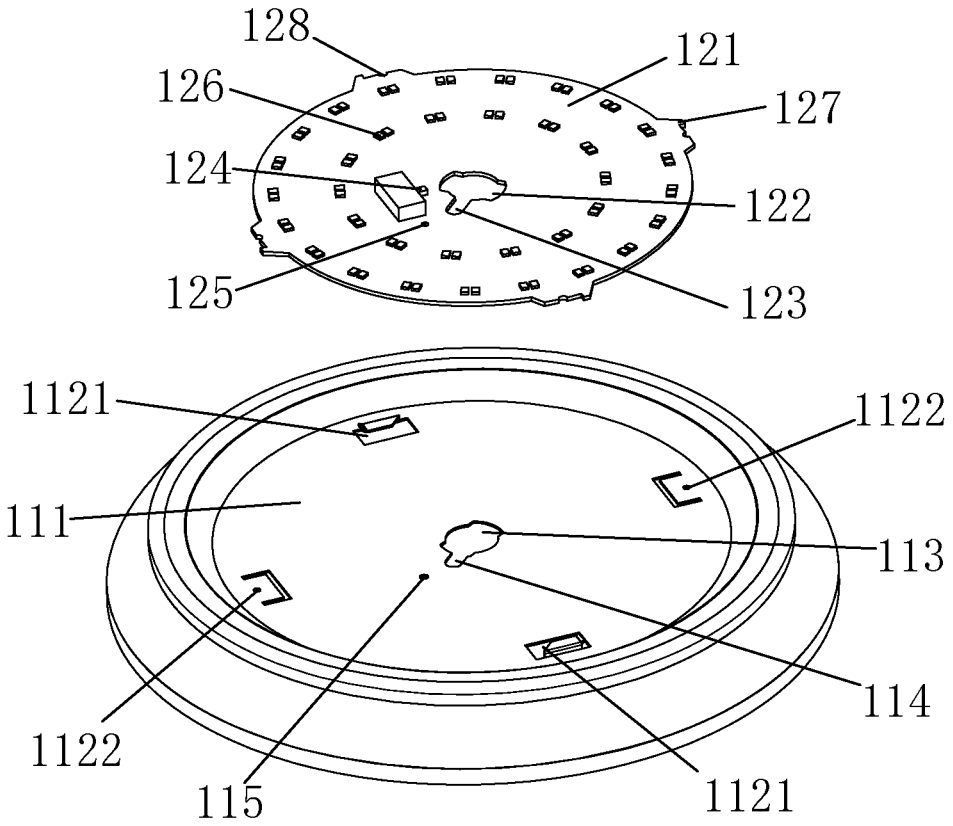
FIG. 11 is a schematic diagram of a matching relationship between the mounting plate and the light-emitting member of the ceiling light according to the present disclosure.

Specifically, when the tube chamber 144 of the casing 14 has a circular cross section (as shown in FIG. 10), and the core bar 151 of the core shaft 15 inserted into the tube chamber 144 has an adapted cross section, the casing 14 can rotate around the core shaft 15. Since the core shaft 15 is fixedly connected to surface to be installed, at this time, by directly rotating the casing 14, or indirectly rotating the casing 14 through rotating other structures attached outside the casing 14, the action member 140 acts on the responsive member 120, so that the lighting parameters of the light-emitting member 12 can be regulated.

It should be noted that although the whole composed of the mounting plate 11 and the light-emitting member 12 can rotate relative to the casing 14 or the core shaft 15, since the weight of the whole is relatively heavy and the torque required to drive the rotation is relatively large, and the torque required to rotate the casing 14 itself is very small, therefore, during regulating the lighting parameters of the light-emitting member 12, the whole composed of the mounting plate 11 and the light-emitting member 12 will not rotate with the casing 14.

It can be understood that one end of the core shaft 15 is connected to the surface to be installed. The surface to be installed can be a ceiling, a beam-column structure in the factory, or other positions such as an inclined or vertical wall where the core shaft 15 can be installed. It is usually installed on the ceiling, but it doesn't mean that it can only be installed here.

Specifically, the core shaft 15 includes a fixing plate 152 at the end thereof close to the port of the mounting plate 11. The fixing plate 152 is connected to the surface of the ceiling light 1 to be installed. Since the adjusting assembly 10 connects the mounting plate 11 and the light-emitting member 12, and the core shaft 15 of the adjusting assembly 10 provides the fixing plate 152 at the end thereof; then by connecting the fixing plate 152 and the surface of the ceiling light 1 to be installed, the entire light can be connected to the surface to be installed.

More specifically, the core shaft 15 includes a core bar 151 penetrating into the casing 14. The core bar 151 provides the fixing plate 152 at the end thereof, passing through the casing 14 and close to the port of the mounting plate 11. The fixing plate 152 is connected to the surface of the ceiling light 1 to be installed through connecting elements or adhesive materials. It can be understood that the core bar 151 of the core shaft 15 is configured to connect the mounting plate 11 and the light-emitting member 12. The fixing plate 152 is connected to the core bar 151. The entire light can be connected to the surface to be installed through connecting elements or adhesive materials.

Referring to FIGS. 2-5, further, the action member 140 is a dial wheel 143 disposed at the outer side of the casing 14 corresponding to the light-emitting member 12. The responsive member 120 is an adjustment knob 124 adapted to the dial wheel 143. When the mounting plate 11 and the casing 14 relatively move in the circumferential direction, the dial wheel 143 toggles the adjustment knob 124, so as to regulate the light-emitting member 12. It can be understood that the dial wheel 143 is disposed on the casing 14, for acting on the adjustment knob 124 disposed on the light-emitting member 12 when the mounting plate 11 circumferentially moves relative to the adjusting assembly 10. The adjustment knob 124 is adapted to the dial wheel 143 to receive the response, thereby realizing the regulation of the lighting parameters such as the light intensity and color temperature of the light-emitting element 12. That is, when the lighting parameters need to be adjusted, rotating the mounting plate 11 (when the casing 14 and the core shaft 15 are circumferentially limited) or rotating the casing 14 (when the casing 14 and the core shaft 15 are rotatably connected), so that the dial wheel 143 toggles the adjustment knob 124, thereby realizing the regulation of the lighting parameters of the light-emitting member 12.

It should be noted that the adjustment knob 124 may only be a dial knob adapted to the dial wheel 143, or the light-emitting member 12 includes an adjustment box, the adjustment knob 124 partially penetrates out of the adjustment box to form the dial knob adapted to the dial wheel 143. In addition, the adjustment knob 124 may have several settings with each setting matching with certain lighting parameters or lighting modes, or it may be electrodelessly adjusted and have a series of continuous lighting parameters or lighting modes.

Figure 5:
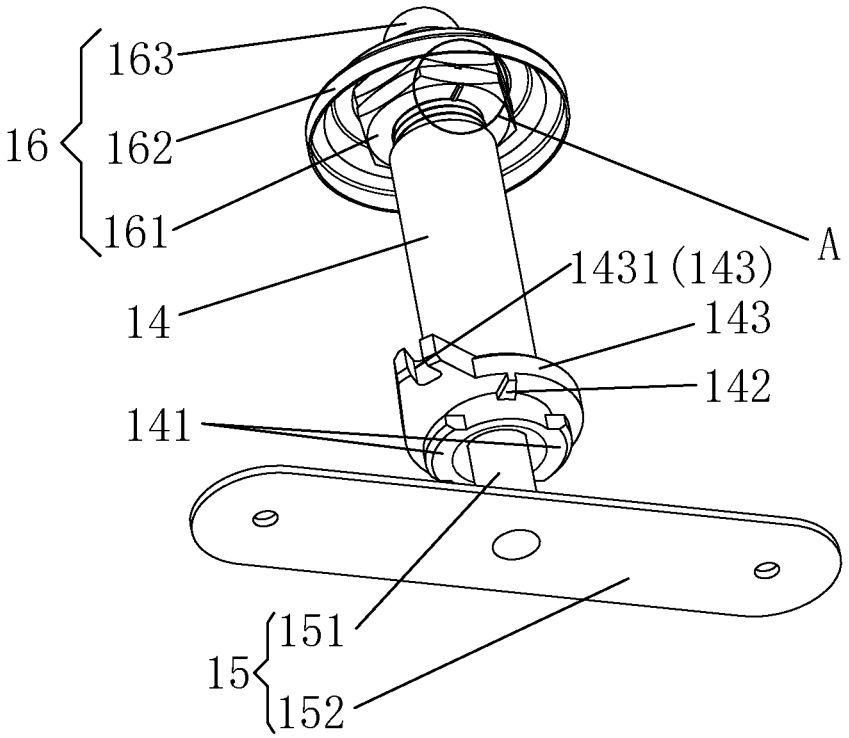
FIG. 5 is a perspective view of a casing, a core shaft and a locking assembly of the ceiling light according to the present disclosure.

Referring to FIG. 5, preferably, the dial wheel 143 defines a notch 1431 at a side thereof toward the adjustment knob 124. The notch 1431 extends radially along the casing 14. The circumferential width of the notch 1431 on the centripetal side is larger than that of the notch 1431 on the centrifugal side. That is, the bottom of the notch 1431 is wide and the mouth of the notch 1431 is narrow, which can ensure that during the relative rotation of the casing 14 and the mounting plate 11, the adjustment knob 124 is always kept in the notch 1431 without disengagement. It should be noted that the overall size of the dial wheel 143 can be slightly larger, so that the notch 1431 is directly defined at the rim position of the dial wheel 143. The overall size of the dial wheel 143 can also be slightly smaller, while the dial wheel 143 includes a protruding part corresponding to the adjustment knob 124 and extending toward the adjustment knob 124, the notch 1431 is disposed on the protruding part, thereby reducing the material usage, reducing the weight and controlling the costs.

Referring to FIGS. 3-6, further, the ceiling light 1 further includes a lamp cover 13 fastened to the mounting plate 11. The light-emitting member 12 is sandwiched between the mounting plate 11 and the lamp cover 13. The adjusting assembly 10 runs through the mounting plate 11, the light-emitting member 12 and the lamp cover 13. A locking assembly 16 is disposed at an end of the casing 14 and the core shaft 15 passing through the lamp cover 13. The locking assembly 16 includes a locking element 161 engaged with the outer side of the casing 14. The side of the locking element 161 toward the lamp cover 13 abuts against the lamp cover 13. The lamp cover 13 is fastened to the mounting plate 11, which can protect the light-emitting member 12, the action member 140 and the responsive member 120, etc. The locking assembly 16 is disposed at the end of the casing 14 passing through the lamp cover 13, which can limit the position of the lamp cover 13 on the casing 14. The locking element 161 is engaged with the outer side of the casing 14 and abuts against the lamp cover 13, which can fasten the lamp cover 13 to the mounting plate 11.

Specifically, the lamp cover 13 includes a bowl-shaped or partially spherical or other common-shaped cover body 131, and a hole 132 defined at the middle of the cover body 131 for the casing 14 passing through. The size of the hole 132 is adapted to the outer diameter of the casing 14.

Figure 6:
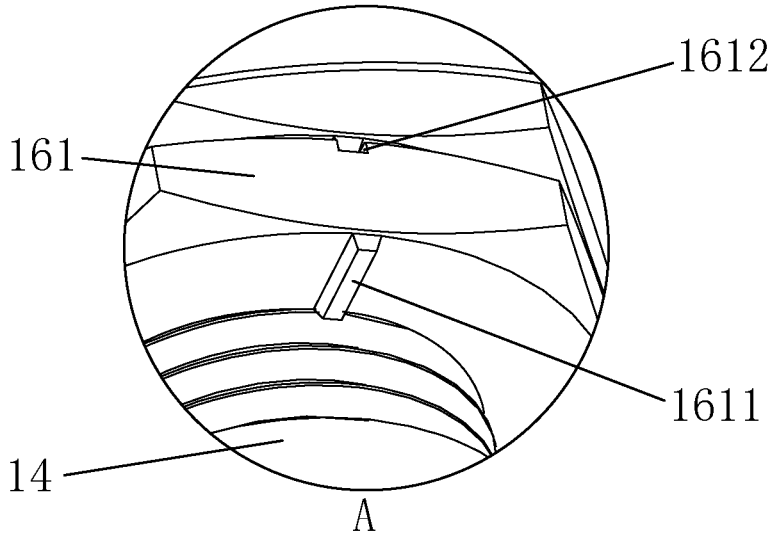
FIG. 6 is an enlarged view of a portion A shown in FIG. 5.

Referring to FIG. 6, optionally, the locking element 161 may have an anti-loosening structure or be in an anti-loosening form. For example, the locking element 161 can be a double nut, or a structure that a latch and a wedge is arranged between the nut and the casing 14, or other commonly used anti-loosening forms of fasteners. Preferably, the locking element 161 is a double nut. A protrusion 1611 and a groove 1612 radially extending is provided on the abutting surface of the double nut, so that the double nut is more tightly fastened.

Referring to FIGS. 3-6 again, further, the locking assembly 16 further includes a housing 162 sleeved on the outer side of the casing 14. The housing 162 has an outer edge extending to the lamp cover 13, for covering the locking element 161. The core shaft 15 includes an end cap 163 disposed at an end thereof passing through the casing 14 and close to the port of the lamp cover 13, so that the housing 162 abuts against the lamp cover 13. It can be understood that the housing 162 can cover and wrap the locking element 161, which is more durable and beautiful. The end cap 163 can limit the casing 14 in the axial direction and the core shaft 15, thereby limiting the overall position of the mounting plate 11, the light-emitting member 12, the lamp cover 13 and the casing 14 on the core shaft 15, so that the mounting plate 11 is closely attached to the surface of the ceiling light 1 to be installed. When the locking element 161 is preferably a nut, the housing 162 can also prevent the thread from being exposed, which avoid the problem that the nut is difficult to turn due to rust and dirt on the thread.

Figure 4:
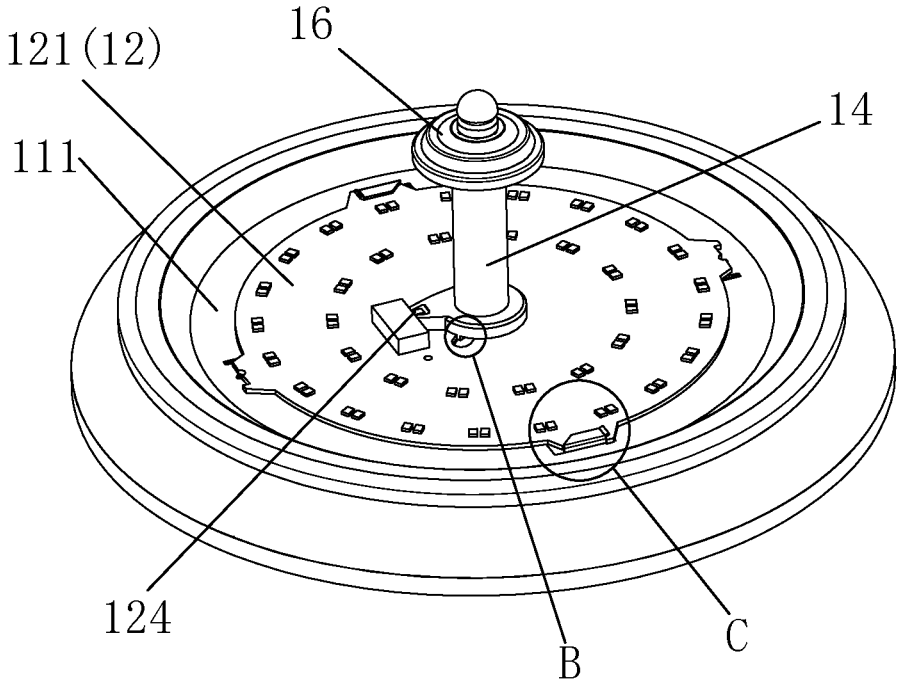
FIG. 4 is a perspective view of the ceiling light without a lamp cover according to the present disclosure.
Figure 7:
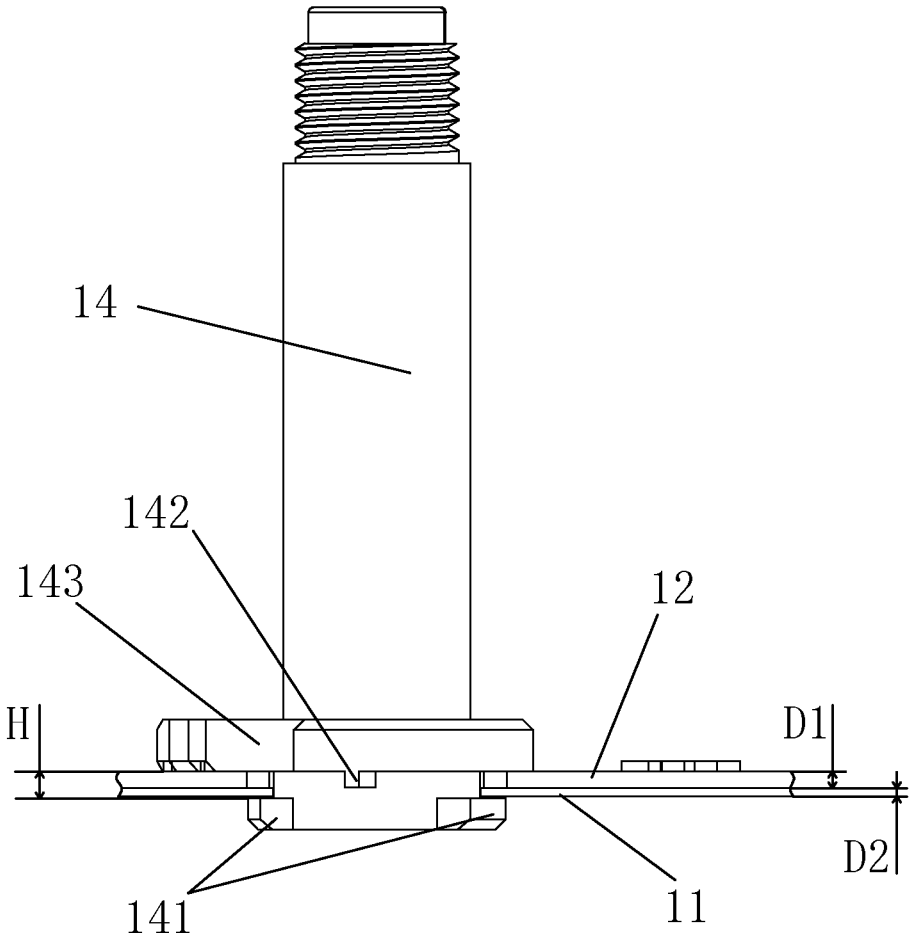
FIG. 7 is a schematic diagram of a position relationship between a mounting plate, a light-emitting member, a dial wheel and a latching block of the ceiling light according to the present disclosure.
Figure 8:
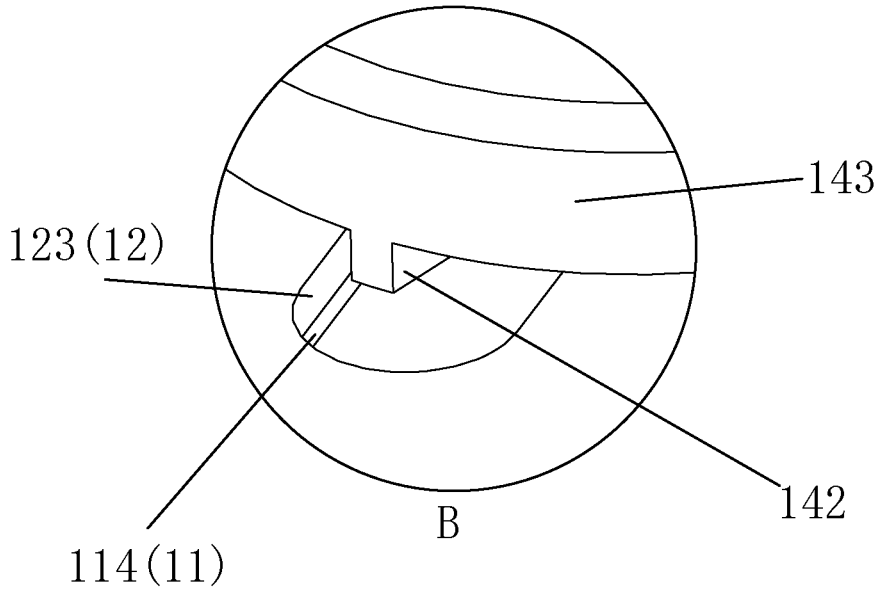
FIG. 8 is an enlarged view of a portion B shown in FIG. 4.

Referring to FIGS. 4 and 7-8, further, the dial wheel 143 includes a limiting member 142 at a side thereof toward the light-emitting member 12. The mounting plate 11 defines a first limiting slot 114 corresponding to the limiting member 142. The light-emitting member 12 defines a second limiting slot 123 corresponding to the limiting member 142. The limiting member 142 extends along the axial direction of the casing 14 at least into the second limiting slot 123. The circumferential widths of the first limiting slot 114 and the second limiting slot 123 along the casing 14 are larger than that of the limiting member 142 along the casing 14. During the mounting plate 11 and the casing 14 relatively move in the circumferential direction, the limiting member 142 is located in the second limiting slot 123, or partially located in the second limiting slot 123 and partially located in the first limiting slot 114. It can be understood that the dial wheel 143 includes the limiting member 142 at the side thereof toward the light-emitting member 12, the limiting member 142 extents into the second limiting slot 123 of the light-emitting member 12, or partially into the second limiting slot 123 of the light-emitting member 12 and partially into the first limiting slot 114 of the mounting plate 11. Since the widths of the first limiting slot 114 and the second limiting slot 123 are larger than that of the limiting member 142, the casing 14 and the mounting plate 11 can circumferentially moves within a certain range, thereby regulating the lighting parameters of the light-emitting member 12.

It should be noted that, since the limiting member 142 extends from the dial wheel 143 toward the side close to the surface to be installed, the limiting member 142 at least penetrates into the second limiting slot 123 of the light-emitting member 12. When the extending dimension of the limiting member 142 is larger than the thickness of the light-emitting member 12, the limiting member 142 passes through the second limiting slot 123 of the light-emitting member 12, and then penetrates into the first limiting slot 114 of the mounting plate 11.

It should be emphasized that the circumferential widths of the first limiting slot 114 and the second limiting slot 123 along the casing 14 are larger than that of the limiting member 142 along the casing 14, the function of the first limiting slot 114 and the second limiting slot 123 is to limit the circumferential rotation between the casing 14 and the mounting plate 11 within a certain boundary range. When the limiting member 142 abuts against one side boundary, the dial wheel 143 toggles the adjustment knob 124 to the endpoint of one side of the adjustment range; when the limiting member 142 abuts against the other side boundary, the dial wheel 143 toggles the adjustment knob 124 to the endpoint of the other side of the adjustment range.

In addition, the mounting plate 11 and the light-emitting member 12 may be provided with a first through hole 115 and a second through hole 125 respectively, so that the telecommunication cable of the adjustment knob 124 passes through the mounting plate 11 and the light-emitting member 12, which can avoid the cable blocking or interfering with the light-emitting surface on the light-emitting member 12. In particular, fasteners such as screws and bolts can also be arranged in the first through hole 115 and the second through hole 125, so as to limit the relative position of the light-emitting member 12 and the mounting plate 11 and avoid the dislocation of the two. The telecommunication cables of electronic devices such as the adjustment knob 124 can pass through the light-emitting member 12 and the mounting plate 11 through the limiting slots (at this time, the limiting slots are relatively long in the radial direction, the centripetal side is used to limit the limiting member 142, and the centrifugal side is used to pass the cable).

Referring to FIGS. 4 and 7-10, further, the casing 14 includes at least one latching block 141 extending radially along the casing 14, at an outer side of an end thereof passing through the mounting plate 11. The latching block 141 and the dial wheel 143 clamp the mounting plate 11 and the light-emitting member 12, so as to limit the mounting plate 11 on the casing 14 in an axial direction. It can be understood that the latching block 141 is located at a side of the mounting plate 11 away from the light-emitting member 12, the dial wheel 143 is located at a side of the light-emitting member 12 away from the mounting plate 11. The distance (H shown in FIG. 7) between adjacent surfaces of the latching block 141 and the dial wheel 143 is equivalent to the distance (as shown in FIG. 7, when the light-emitting member 12 is placed against the mounting plate 11, the distance is the sum of D1 and D2; if there is a gap between the light-emitting member 12 and the mounting plate 11, the distance is the sum of D1, D2 and the gap therebetween) between opposite surfaces of the mounting plate 11 and the light-emitting member 12, therefore, the positions of the mounting plate 11 and the light-emitting member 12 on the casing 14 are limited.

It should be noted that the latching block 141 and the dial wheel 143 clamp the mounting plate 11 and the light-emitting member 12, and the main implementation method is that after the latching block 141 is screwed in place, it will not pass through the light-emitting member 12 or the mounting plate 11, so that the mounting plate 11 and the light-emitting member 12 are limited in an axial direction. Thus, the width of a single latching block 141 in the circumferential direction of the casing 14 or the sum of the widths of multiple latching blocks 141 in the circumferential direction of the casing 14 should account for a central angle of less than 180°. Preferably, when two, three or even more latching blocks 141 are provided, the multiple latching blocks 141 are evenly distributed in the circumferential direction of the casing 14. The latching blocks 141 pass through the light-emitting member 12 and the mounting plate 11, and then are screwed at a certain angle, thereby locking the light-emitting member 12 and the mounting plate 11 on the casing 14 in the axial direction.

Referring to FIGS. 4 and 11-14, further, the mounting plate 11 defines a first latching hole 113 corresponding to the latching block 141. The light-emitting member 12 defines a second latching hole 122 corresponding to the latching block 141. The first latching hole 113 and the second latching hole 122 correspond to different circumferential positions of the casing 14, to limit the casing 14 and the mounting plate 11 in the axial direction. The first latching hole 113 and the second latching hole 122 can be adjusted to be aligned, so that the latching block 141 can pass through when the ceiling light 1 is assembled or disassembled.

It can be understood that, since the latching block 141 and the dial wheel 143 clamp the mounting plate 11 and the light-emitting member 12, and the latching block 141 needs to pass through the mounting plate 11 and the light-emitting member 12, the mounting plate 11 and the light-emitting member 12 respectively define the first latching hole 113 and the second latching hole 122. When the ceiling light 1 needs to be disassembled or assembled, the mounting plate 11 and the light-emitting member 12 relatively rotate to align the first latching hole 113 and the second latching hole 122, for the latching block 141 passing through. After the latching block 141 passes through, the mounting plate 11 and the light-emitting member 12 relatively rotate until the first latching hole 113 and the second latching hole 122 are misaligned; that is, the first latching hole 113 and the second latching hole 122 correspond to different circumferential positions of the casing 14, so that the latching block 141 cannot pass through the mounting plate 11 and the light-emitting member 12, thereby limiting the the casing 14 and the mounting plate 11 in the axial direction, and the ceiling light 1 is in a working state.

Further, the mounting plate 11 is provided with an engaging element 1121 corresponding to the edge of the light-emitting member 12. The light-emitting member 12 is provided with a positioning block 127 corresponding to the engaging element 1121. When the positioning block 127 abuts against the engaging element 1121, the first limiting slot 114 is aligned with the second limiting slot 123. It can be understood that the engaging element 1121 is used to realize the connection between the light-emitting member 12 and the mounting plate 11, especially for the circumferential positioning of the light-emitting member 12 and the mounting plate 11. When the positioning block 127 on the light-emitting member 12 abuts against the engaging element 1121 on the mounting plate 11, the first limiting slot 114 is aligned with the second limiting slot 123, so that the limiting member 142 extends into the second limiting slot 123, or partially into the second limiting slot 123 and partially into the first limiting slot 114. Meanwhile, the first latching hole 113 and the second latching hole 122 are misaligned, to limit the casing 14 and the mounting plate 11 in the axial direction.

It can be understood that a positioning assembly 112 is disposed between the mounting plate 11 and the light-emitting member 12, for realizing the the connection and positioning of the light-emitting member 12 and the mounting plate 11. The engaging element 1121 is only a part of the positioning assembly 112, and is mainly used to keep the light-emitting member 12 and the mounting plate 11 in a specific circumferential direction. Since the first limiting slot 114 is aligned with the second limiting slot 123 after being rotated in place, at this time, if the limiting member 142 axially extends to partially in the second limiting slot 123 and partially in the first limiting slot 114, the limiting member 142 itself can in turn keep the light-emitting member 12 and the mounting plate 11 substantially in the specific circumferential direction.

Figure 12:
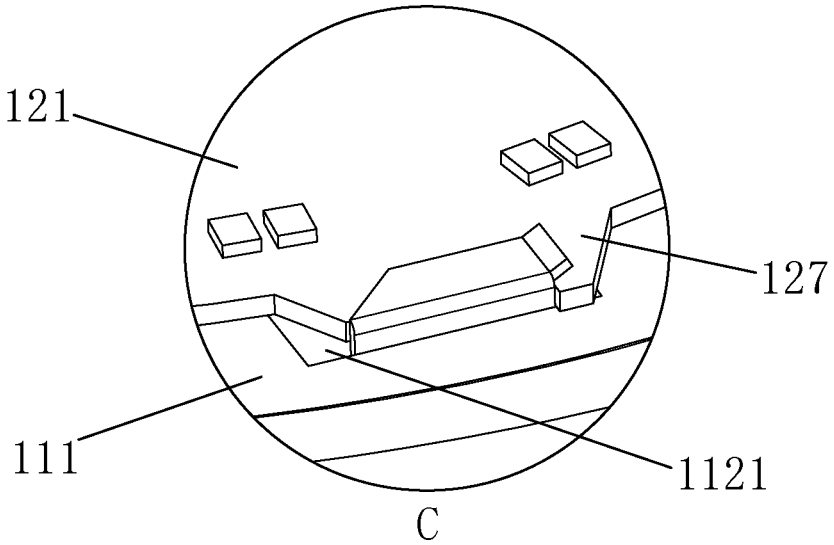
FIG. 12 is an enlarged view of a portion C shown in FIG. 4.

Optionally, the positioning assembly 112 may further include other structures, such as a positioning hole 1122 defined on the mounting plate 11 corresponding to the edge of the light-emitting member 12, and a gap 128 defined on the light-emitting member 12 corresponding to the positioning hole 1122. When the positioning block 127 on the light-emitting member 12 abuts against the engaging element 1121 on the mounting plate 11 (as shown in FIG. 12), the positioning hole 1122 is aligned with the gap 128. If parts such as fasteners are inserted into the positioning hole 1122 and the gap 128, the light-emitting member 12 and the mounting plate 11 can be completely determined in the circumferential direction, even if the limiting member 142 only extends into the second limiting slot 123. In addition, when the positioning block 127 on the light-emitting member 12 abuts against the engaging element 1121 on the mounting plate 11, the first limiting slot 114 is aligned with the second limiting slot 123, so that the limiting member 142 extends into the second limiting slot 123, or partially into the second limiting slot 123 and partially into the first limiting slot 114. At the same time, the first latching hole 113 and the second latching hole 122 are misaligned, to limit the casing 14 and the mounting plate 11 in the axial direction; the first through hole 115 and the second through hole 125 are opposite so that the telecommunication cable of the adjustment knob 124 can pass through.

Figure 13:
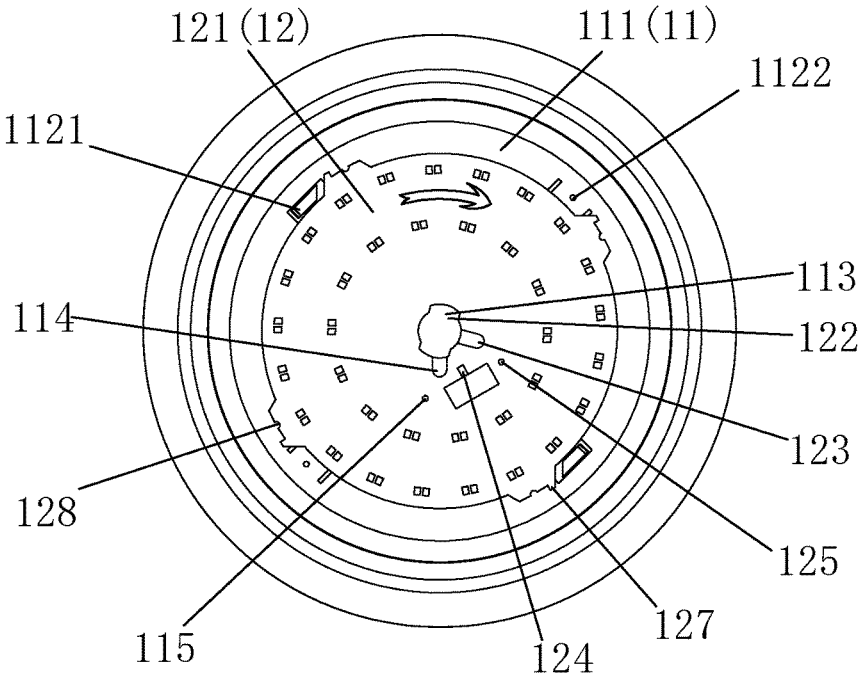
FIG. 13 is a schematic diagram of a position relationship and a movement direction of the mounting plate and the light-emitting member of the ceiling light according to the present disclosure when the ceiling light is disassembled.
Figure 14:
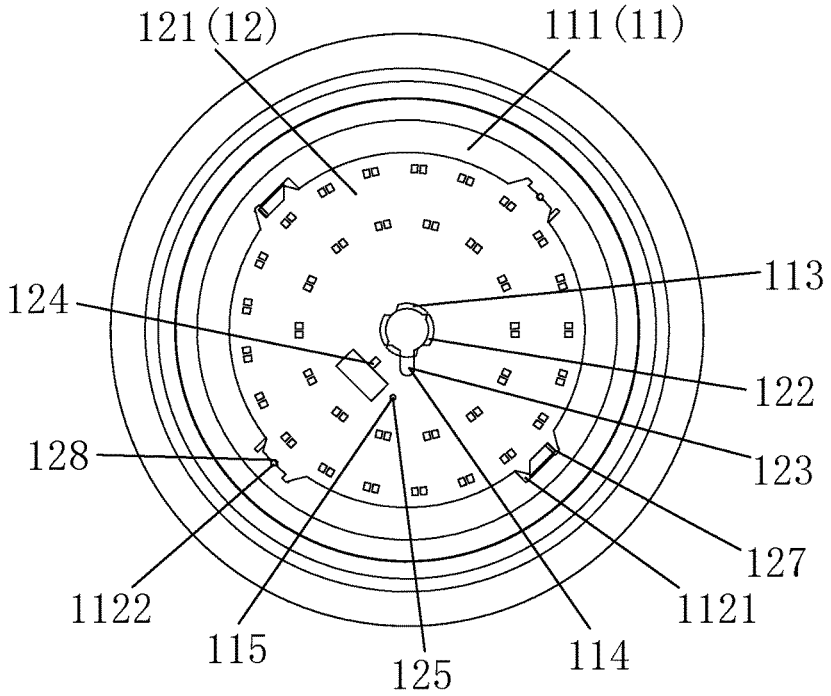
FIG. 14 is a schematic diagram of a position relationship and positioning of the mounting plate and the light-emitting member of the ceiling light according to the present disclosure when the ceiling light is assembled as a whole.

Referring to FIGS. 13-14, (combined with FIGS. 3-4 and the foregoing, those skilled in the art can understand the position of the casing 14 relative to the mounting plate 11 and the light-emitting member 12, so in order to show the hole position relationship, here the casing 14 is omitted, but the casing 14 will still be mentioned in the description) the positional relationship, movement direction, positioning situation, etc. of the mounting plate 11 and the light-emitting member 12 during the disassembly and assembly process and when they are combined as a whole are specifically explained:

The light-emitting member 12 is placed on the mounting plate 11, the first latching hole 113 and the second latching hole 122 are aligned and overlapped, so that the latching block 141 of the casing 14 partially passes through the light-emitting member 12 and the mounting plate 11 from the light-emitting member 12 side. At this time, the engaging element 1121 does not interact with the positioning block 127, the positioning hole 1122 does not interact with the gap 128, the first limiting slot 114 and the second limiting slot 123 are misaligned, the first through hole 115 and the second through hole 125 are misaligned.

When the mounting plate 11 and the light-emitting member 12 are between the dial wheel 143 and the latching block 141, respectively rotate the light-emitting member 12, the casing 14 and/or the mounting plate 11, until the positioning block 127 is engaged into the engaging element 1121, and the protruding part abuts against the edge of the engaging element 1121. In this embodiment, due to the position relationship between the positioning block 127 and the engaging element 1121, the light-emitting member 12 rotates relative to the mounting plate 11 in the direction of the arrow as shown in FIG. 13. At this time, the first limiting slot 114 and the second limiting slot 123 are aligned, the limiting member 142 is located in the second limiting slot 123, or partially in the second limiting slot 123 and partially in the first limiting slot 114, so that the casing 14 can only perform a circumferential rotation relative to the mounting plate 11 and/or the light-emitting member 12 within a limited range. Moreover, the first latching hole 113 and the second latching hole 122 are misaligned, the latching block 141 cannot directly pass through the mounting plate 11 or the light-emitting member 12, and the dial wheel 143 and the latching block 141 limit the positions of the mounting plate 11 and the light-emitting member 12 on the casing 14. In addition, the first through hole 115 and the second through hole 125 are aligned for the telecommunication cable of the adjusting knob 124 passing through, and the positioning hole 1122 and the gap 128 are aligned.

The foregoing descriptions of the embodiments according to the present disclosure should not be construed as limiting the scope of the disclosure but as merely providing illustrations of some of the preferred embodiments thereof. Thus the scope of the disclosure should be determined by the appended claims and their legal equivalents. Furthermore, it will be apparent to those skilled in the art that various modifications, equivalents and improvements can be made herein within the scope of the disclosure.

The invention claimed is:

1. A ceiling light, comprising a mounting plate, a light-emitting member and an adjusting assembly, wherein the light-emitting member is disposed on the mounting plate, the light-emitting member and the mounting plate are fixed in a circumferential direction, the adjusting assembly runs through the mounting plate and the light-emitting member, the mounting plate and the adjusting assembly are adjustable in a circumferential direction;

the adjusting assembly comprising an action member on an outer side thereof corresponding to the light-emitting member, the light-emitting member comprising a responsive member corresponding to lighting parameters; the action member being a dial wheel, and the responsive member being an adjustment knob which is adapted to the dial wheel; when the mounting plate and the adjusting assembly relatively move in the circumferential direction, the dial wheel toggling the adjustment knob to regulate the light-emitting member.

2. The ceiling light according to claim 1, wherein the dial wheel comprises a limiting member at a side thereof toward the light-emitting member, the mounting plate defines a first limiting slot corresponding to the limiting member, and the light-emitting member defines a second limiting slot corresponding to the limiting member;

during the mounting plate and the adjusting assembly relatively move in the circumferential direction, the limiting member being at least partially located in the second limiting slot.

3. The ceiling light according to claim 2, wherein the circumferential widths of the first limiting slot and the second limiting slot along the adjusting assembly are larger than that of the limiting member along the adjusting assembly.

4. The ceiling light according to claim 1, wherein the adjusting assembly comprises a latching block at the outer side of an end thereof passing through the mounting plate, the latching block and the dial wheel clamp the mounting plate and the light-emitting member, so as to limit the mounting plate and the light-emitting member on the adjusting assembly in an axial direction.

5. The ceiling light according to claim 4, wherein the mounting plate defines a first latching hole corresponding to the latching block, and the light-emitting member defines a second latching hole corresponding to the latching block;

the first latching hole and the second latching hole can be adjusted to be aligned, for the latching block passing through.

6. The ceiling light according to claim 5, wherein the mounting plate comprises an engaging element corresponding to an edge of the light-emitting member, the light-emitting member comprises a positioning block corresponding to the engaging element; when the positioning block abuts against the engaging element, the first limiting slot being aligned with the second limiting slot.

7. The ceiling light according to claim 6, wherein the mounting plate defines a first through hole, and the light-emitting member defines a second through hole;

when the positioning block abuts against the engaging element, the first through hole being aligned with the second through hole.

8. The ceiling light according to claim 1, wherein the ceiling light further comprises a lamp cover fastened on the mounting plate, and the light-emitting member is sandwiched between the mounting plate and the lamp cover;

the adjusting assembly running through the mounting plate, the light-emitting member and the lamp cover.

9. The ceiling light according to claim 8, wherein the adjusting assembly comprises a locking assembly disposed at an end thereof passing through the lamp cover, the locking assembly comprises a locking element, and a side of the locking element towards the lamp cover abuts against the lamp cover.

10. The ceiling light according to claim 9, wherein the the locking element comprises an anti-loosening structure.

11. The ceiling light according to claim 9, wherein the locking assembly further comprises a housing sleeved on the outer side of the adjusting assembly, the housing comprises an outer edge extending to the lamp cover, to cover the locking element; and the adjusting assembly comprises an end cap disposed at an end thereof close to the lamp cover, so that the housing abuts against the lamp cover.

12. The ceiling light according to claim 1, wherein the adjusting assembly comprises a casing and a core shaft passing through the casing;

the casing comprising a tube chamber with a non-circular cross section, which is circumferentially limited with the core shaft; or the casing comprising a tube chamber with a circular cross section, which is rotatably connected to the core shaft;

the action member being a dial wheel which is disposed on the outer side of the adjusting assembly corresponding to the light-emitting member, and the responsive member being an adjustment knob which is adapted to the dial wheel.

13. The ceiling light according to claim 12, wherein one end of the core shaft away from the light-emitting member passes through the casing and is connected to a surface of the ceiling light to be installed, the other end of the core shaft away from the mounting plate passes through the casing and limits the casing in an axial direction.

14. The ceiling light according to claim 13, wherein the core shaft comprises a fixing plate at the end thereof passing through the casing and close to the mounting plate, the fixing plate is connected to the surface of the ceiling light to be installed.

15. The ceiling light according to claim 12, wherein the dial wheel defines a notch at a side towards the adjustment knob, the notch extends radially along the casing, and the circumferential width of the notch on the centripetal side is larger than that of the notch on the centrifugal side.

16. The ceiling light according to claim 1, wherein the adjustment knob can be a dial knob adapted to the dial wheel, or the light-emitting member comprises an adjustment box, the adjustment knob partially penetrates out of the adjustment box to form the dial knob adapted to the dial wheel.

17. The ceiling light according to claim 16, wherein the adjustment knob comprises several settings with each setting matching with at least one lighting parameter or lighting mode, or the adjustment knob is electrodelessly adjusted and comprises a series of continuous lighting parameters or lighting modes.

18. The ceiling light according to claim 1, wherein the mounting plate comprises a plate body and an arc edge disposed at an edge of the plate body, the plate body and the arc edge form a bowl-shaped structure which is fastened to the surface to be installed, thereby defining an operating space at a side of the plate body away from the light-emitting member.

19. An adjustment method of a ceiling light, the ceiling light comprising a light-emitting member and an adjusting assembly; the adjusting assembly running through the light-emitting member, and the light-emitting member and the adjusting assembly being adjustable in a circumferential direction; the adjusting assembly comprising an action member on an outer side thereof, the light-emitting member comprising a responsive member correspondingly; the action member being a dial wheel, and the responsive member being an adjustment knob which is adapted to the dial wheel; the adjustment method comprising the following steps: making the light-emitting member and the adjusting assembly relatively moving in the circumferential direction, and the dial wheel toggling the adjustment knob to regulate the light-emitting member.

* * * * *